US011805364B2

(12) United States Patent
Udesen

(10) Patent No.: US 11,805,364 B2
(45) Date of Patent: Oct. 31, 2023

(54) HEARING DEVICE PROVIDING VIRTUAL SOUND

(71) Applicant: GN Audio A/S, Ballerup (DK)

(72) Inventor: Jesper Udesen, Ballerup (DK)

(73) Assignee: GN AUDIO A/S, Ballerup (DK)

( * ) Notice: Subject to any disclaimer, the term of this patent is extended or adjusted under 35 U.S.C. 154(b) by 0 days.

(21) Appl. No.: 16/704,469

(22) Filed: Dec. 5, 2019

(65) Prior Publication Data

US 2020/0196058 A1 Jun. 18, 2020

(30) Foreign Application Priority Data

Dec. 13, 2018 (EP) ..... 18212246

(51) Int. Cl.
*H04R 5/033* (2006.01)
*H04R 3/00* (2006.01)
(Continued)

(52) U.S. Cl.
CPC ..... *H04R 5/033* (2013.01); *H04R 3/005* (2013.01); *H04R 3/04* (2013.01); *H04R 5/027* (2013.01);
(Continued)

(58) Field of Classification Search
CPC ..... H04R 5/003; H04R 5/027; H04R 5/04; H04R 5/033; H04R 1/1083; H04R 3/005;
(Continued)

(56) References Cited

U.S. PATENT DOCUMENTS 7,031,460 B1 4/2006 Zheng et al.
7,936,887 B2 5/2011 Smyth
(Continued)

FOREIGN PATENT DOCUMENTS

JP 2007036608 2/2007

OTHER PUBLICATIONS

Sound Localization With Head Movement: Implications For 3-D Audio Displays; Ken I. Mcanally | Russell L. Martin; 12 pages, Aug. 12, 2014.

(Continued)

*Primary Examiner* — Ahmad F. Matar
*Assistant Examiner* — Sabrina Diaz
(74) *Attorney, Agent, or Firm* — HAMRE, SCHUMANN, MUELLER & LARSON, P.C.

(57) ABSTRACT

Disclosed is a method and a hearing device for audio transmission. The hearing device is configured to be worn by a user. The hearing device comprises a first earphone comprising a first speaker. The hearing device comprises a second earphone comprising a second speaker. The hearing device comprises a virtual sound processing unit connected to the first earphone and the second earphone. The virtual sound processing unit is configured for receiving and processing an audio sound signal for generating a virtual audio sound signal. The virtual audio sound signal is forwarded to the first and second speakers, where the virtual audio sound appears to the user as audio sound coming from two virtual speakers in front of the user. The hearing device further comprises a first primary microphone for capturing surrounding sounds to provide a first surrounding sound signal based on a first primary input signal from the first primary microphone. The first primary microphone being arranged in the first earphone for providing a first rear facing sensitivity pattern towards the rear direction. The hearing device further comprises a first secondary microphone for capturing surrounding sounds to provide a second surrounding sound signal based on a first secondary input signal from the first secondary microphone. The first secondary microphone being arranged in the second earphone for providing a second rear facing sensitivity pattern towards the rear direction. The hearing device is configured for transmitting the first surrounding sound signal to the first speaker. The (Continued)

hearing device is configured for transmitting the second surrounding sound signal to the second speaker. Thereby the user receives the surrounding sound from the rear direction, while the surrounding sound from the front direction is attenuated compared to the surrounding sound from the rear direction.

15 Claims, 7 Drawing Sheets

(51) Int. Cl.

| | |
|---|---|
| ***H04R 3/04*** | (2006.01) |
| ***H04R 5/027*** | (2006.01) |
| ***H04R 5/04*** | (2006.01) |
| ***H04S 1/00*** | (2006.01) |
| ***H04S 7/00*** | (2006.01) |

(52) U.S. Cl.
CPC ..... *H04R 5/04* (2013.01); *H04S 1/005* (2013.01); *H04S 7/304* (2013.01); *H04S 2420/01* (2013.01)

(58) Field of Classification Search
CPC ..... H04R 3/04; G10K 2210/1081; G10K 2210/108; G10K 11/1788; H04S 1/005; H04S 1/007; H04S 7/304; H04S 2420/01; H04S 2400/01
USPC ..... 381/309, 310, 71.6
See application file for complete search history.

(56) References Cited

U.S. PATENT DOCUMENTS

| | | | | |
|---|---|---|---|---|
| 9,649,225 | B2 | 5/2017 | Kirsch et al. | |
| 9,681,246 | B2 | 6/2017 | Horbach | |
| 9,913,022 | B2 * | 3/2018 | Dusan | H04R 1/1083 |
| 9,949,053 | B2 | 4/2018 | Grosche et al. | |
| 9,980,075 | B1 | 5/2018 | Benattar | |
| 10,375,506 | B1 * | 8/2019 | Moeller | H04R 5/033 |
| 2010/0290636 | A1 | 11/2010 | Mao et al. | |
| 2013/0243214 | A1 * | 9/2013 | Penketh | G10K 11/17885 381/71.1 |
| 2014/0126736 | A1 | 5/2014 | Gauger, Jr. et al. | |
| 2014/0270231 | A1 | 9/2014 | Dusan et al. | |
| 2015/0230026 | A1 * | 8/2015 | Eichfeld | H04R 25/407 381/26 |
| 2015/0249898 | A1 * | 9/2015 | Horbach | H04S 1/005 381/309 |
| 2016/0012816 | A1 | 1/2016 | Fujisawa | |
| 2016/0125867 | A1 | 5/2016 | Jarvinen et al. | |
| 2016/0192073 | A1 | 6/2016 | Poornachandran et al. | |
| 2018/0014107 | A1 | 1/2018 | Razouane et al. | |
| 2018/0324514 | A1 * | 11/2018 | Dusan | G10K 11/17879 |

OTHER PUBLICATIONS

3D Audio on Headphones: How Does It Work?; Waves, 7 pages, Jun. 23, 2016.
"The benefit of binaural hearing in a cocktail party: effect of location and type of interferer", by Hawley ML, Litovsky RY, Culling JF, in J Acoust Soc Am. Feb. 2004;115(2):833-43.
Extended European search report for European patent application No. 18212246.5 dated May 24, 2019.

* cited by examiner

*Fig. 1a) PRIOR ART*

HEARING DEVICE PROVIDING VIRTUAL SOUND

FIELD

The present disclosure relates to a method and a hearing device for audio transmission configured to be worn by a user. The hearing device comprises a first earphone comprising a first speaker; a second earphone comprising a second speaker; and a virtual sound processing unit connected to the first earphone and the second earphone, the virtual sound processing unit is configured for receiving and processing an audio sound signal for generating a virtual audio sound signal, wherein the virtual audio sound signal is forwarded to the first and second speakers, where the virtual audio sound appears to the user as audio sound coming from two virtual speakers in front of the user.

BACKGROUND

Hearing devices, such as headsets or headphones, can be used in different situations. Users can wear their hearing devices in many different environments, e.g. at work in an office building, at home when relaxing, on their way to work, in public transportation, in their car, when walking in the park etc. Furthermore, hearing devices can used for different purposes. The hearing devices can be used for audio communication, such as telephone calls. The hearing devices can be used for listening to music, radio etc. The hearing devices can be used as a noise cancellation device in noisy environments etc.

It is well known that listening to music with headphones on in a traffic environment can be a safety problem.

One way to overcome this problem could be to blend in surrounding traffic sounds, called a "hear through" mode of the hearing device, but it is a disadvantage that the perceived music quality is degraded. The surrounding sounds and the music are mixed together and the human brain is not able to separate the music and the traffic sounds leading to a "blurry" mixture of confusing sounds which compromises music sound quality.

Another solution could be to have an algorithm which identifies, e.g. based on artificial intelligence, all the "relevant" traffic" sounds and play them through the headphones. However, such an algorithm does not yet exist and it is not clear if such a method would influence the sound quality of the music.

Thus, there is a need for an improved hearing device enabling the hearing device user to listen to audio e.g. music or having phone calls, in a traffic environment in a safe way while maintaining the sound quality of the audio, such as maintaining the music sound quality.

SUMMARY

Disclosed is a hearing device for audio transmission. The hearing device is configured to be worn by a user. The hearing device comprises a first earphone comprising a first speaker. The hearing device comprises a second earphone comprising a second speaker. The hearing device comprises a virtual sound processing unit connected to the first earphone and the second earphone. The virtual sound processing unit is configured for receiving and processing an audio sound signal for generating a virtual audio sound signal. The virtual audio sound signal is forwarded to the first and second speakers, where the virtual audio sound appears to the user as audio sound coming from two virtual speakers in front of the user. The hearing device further comprises a first primary microphone for capturing surrounding sounds to provide a first surrounding sound signal based on a first primary input signal from the first primary microphone. The first primary microphone being arranged in the first earphone for providing a first rear facing sensitivity pattern towards the rear direction. The hearing device further comprises a first secondary microphone for capturing surrounding sounds to provide a second surrounding sound signal based on a first secondary input signal from the first secondary microphone. The first secondary microphone being arranged in the second earphone for providing a second rear facing sensitivity pattern towards the rear direction. The hearing device is configured for transmitting the first surrounding sound signal to the first speaker. The hearing device is configured for transmitting the second surrounding sound signal to the second speaker. Thereby the user receives the surrounding sound from the rear direction, while the surrounding sound from the front direction is attenuated compared to the surrounding sound from the rear direction.

This is a solution based on 3D spatial audio. The audio sound, e.g. music, and the surrounding sound, e.g. traffic noise, are separated into two different spatial sound objects: audio sound, e.g. music, from the front direction and surrounding sounds, e.g. traffic, from the rear direction where the user has no visual contact to potential objects, such as traffic objects. In this way the human brain can better segregate between the sounds of interests and the sound quality of the music is preserved.

The solution combines providing a rear facing sensitivity pattern towards the rear direction and providing arrangement of two virtual speakers in front of the user. It is an advantage that this can improve the user's awareness of the surrounding environment, e.g. traffic awareness. The virtual speakers playing audio, e.g. music, which sounds like coming from the front of the user, will reduce the need to increase music, or conversation, volume in the headphones. Thus the risk of the user not hearing the surrounding environment, e.g. traffic, from behind is reduced.

The solution may be used in traffic, as used as the example in this application, however, the hearing device is naturally not limited to be used in traffic. The hearing device can be used in all environments where the user wish to listen to music, radio, any other audio, having phone calls etc. using the hearing device, and at the same time the user wishes to be able to hear the surroundings, in particular the sounds coming from behind the user, as the user can visually see what is in front or to the side of him/her, but not see what is behind. By enabling the user wearing the hearing device to better hear and identify the sounds coming from behind, the user can orientate and keep informed of what is behind him/her. The things in front of the user will the user be able to visually identify, therefore the sounds coming from in front of the user can be turned down or attenuated. Besides being used in traffic, this can be used also at work, e.g. sitting in an office space, such that the user can hear if a colleague is approaching from behind; or used in a supermarket, such that the user can hear if another customer behind the user is talking to the user etc.

Thus, the solution is a system where surrounding environment sounds, e.g. traffic sounds, are attenuated from the front direction and music is played from two virtual speakers from the front direction. A head tracking sensor may be provided in the hearing device for compensating for fast head movements leading to a more externalized sound experience of the two virtual speakers. In this way the brain of the hearing device user is able to create two distinct soundscapes—one for the music and one for surrounding environment, e.g. traffic—and switch attention between the surrounding environment sounds and the music when needed.

It is well documented in the scientific literature that such a spatial unmasking or spatial separation of sounds will lead to improved listening experience, see e.g. the article "The benefit of binaural hearing in a cocktail party: effect of location and type of interferer", by Hawley M L, Litovsky R Y, Culling J F, in J Acoust Soc Am. 2004 February; 115(2):833-43.

The solution may be based on one or more of the following assumptions:

- The user wants to listen to music, in stereo, through the hearing device while he/she is in a surrounding environment, e.g. walks or cycles in a traffic environment. At the same time the user wants to hear the most important surrounding environment sounds, e.g. traffic sounds.
- Environment sounds, e.g. traffic sounds, coming from the rear direction are more important to preserve than sounds, e.g. traffic sounds, coming from the front direction, where the user has visual contact to the sound source.
- Relevant surrounding environment sounds, e.g. traffic sounds for improved traffic safety, are mostly above 200-500 Hz.
- The hearing device has at least one built in microphone in each earphone, such as four build in microphones, i.e. two in each earphone. However, there may be more microphones, such as eight microphones in total, i.e. four microphones in each earphone.
- There may be a head tracking sensor in the hearing device. The head tracking sensor comprises an accelerometer, a magnetometer and a gyroscope. The purpose of the head tracking sensor is to increase the perceived sound externalization of the two virtual speakers.

The solution comprises that a microphone in each earphone is arranged to provide a rear facing sensitivity pattern, which listens mostly towards the rear direction, for environment sound. The microphone in each earphone may be a directional microphone or an omnidirectional microphone.

In some examples the solution may comprise more microphones in each earphone, and then the signals from the two, three or four, microphones in each earphone or ear cup are beamformed to create a rear facing sensitivity pattern, which listens mostly towards the rear direction.

The, e.g. beamformed, environment sound, e.g. traffic sound, is send separately to each earphone leading to the impression that environment sounds, e.g. traffic sounds, are at a natural level from the rear direction and attenuated from the front direction. The expected directivity improvement, relative to the open ear, from the rear direction may be about 3-5 dB, which may depend on hearing device geometry. The auditory spatial cues for all environment objects, e.g. traffic objects, may still be preserved, the intensity of the environment sound, e.g. traffic sound, may be decreased but the perceived direction is preserved.

Thus, this solution provides that the user's own brain focus on the environment sounds, e.g. traffic sounds, when needed without sacrificing music sound quality. Thus, the spatial sound is preserved, and the user can segregate between the relevant sound sources.

The hearing device may be a headset, headphones, earphones, speakers, earpieces, etc. The hearing device is configured for audio transmission, such as transmission of audio sound, such as music, radio, phone conversation, phone calls etc. The first earphone comprises a first speaker. The first speaker may be arranged at the user's first ear, e.g. the left ear. The first earphone may be configured for reception of an audio sound signal. The hearing device comprises a second earphone comprising a second speaker. The second speaker may be arranged at the user's second ear, e.g. the right ear. The second earphone may be configured for reception of an audio sound signal. The first and second earphones may be configured for receiving the audio sound signal from an external device, such as a smartphone, playing the audio sound, such as music.

The hearing device comprises a virtual sound processing unit connected to the first earphone and the second earphone. The virtual sound processing unit is configured for receiving and processing an audio sound signal for generating a virtual audio sound signal. The audio sound signal may be from an external device, e.g. a smartphone playing music. The audio sound may be sent as stereo sound from the first and second speakers into the user's ears. The earphone speakers may generate sound such as audio from the sound signal. The virtual sound processing unit may receive an audio signal from the external device and then generate two audio signals, which are forwarded to the speakers. The virtual audio sound signal is forwarded to the first and second speakers, where the virtual audio sound appears to the user as audio sound coming from two virtual speakers in front of the user.

The virtual audio sound may be provided by means of head-related transfer functions. The virtual audio sound is audio in the first and second speaker, however the user perceives the audio sound as coming from two speakers in front of her/him. As there are no speakers in space in front of the user, the term virtual speakers is used to indicate that the audio sound is processed such that the audio appears, for the user wearing the hearing device, as coming from speakers in front of the user.

The hearing device further comprises a first primary microphone for capturing surrounding sounds to provide a first surrounding sound signal based on a first primary input signal from the first primary microphone. The surrounding sounds may be sounds from the surroundings, sounds in the environment, such as traffic noise, office noise etc. The first primary microphone is arranged in the first earphone for providing a first rear facing sensitivity pattern towards the rear direction. The first rear facing sensitivity pattern may be a left side pattern, i.e. for the user's left ear. The first rear facing sensitivity pattern towards the rear direction may point rearwards or behind the hearing device or the user, such as 180 degrees rearwards.

The hearing device further comprises a first secondary microphone for capturing surrounding sounds to provide a second surrounding sound signal based on a first secondary input signal from the first secondary microphone. The first secondary microphone being arranged in the second earphone for providing a second rear facing sensitivity pattern towards the rear direction. The second rear facing sensitivity pattern may be a right side pattern, i.e. for the user's right ear. The second rear facing sensitivity pattern towards the rear direction may point rearwards or behind the hearing device or the user, such as 180 degrees rearwards.

The hearing device is configured for transmitting the first surrounding sound signal to the first speaker. The hearing device is configured for transmitting the second surrounding sound signal to the second speaker. Thereby the user receives the surrounding sound from the rear direction, while the surrounding sound from the front direction is attenuated compared to the surrounding sound from the rear direction. Thus the direction of the surrounding sound is preserved. The user receives the surrounding sound from the rear direction, whereas the surrounding sound from the front direction is attenuated.

The virtual audio sound may be provided by means of head-related transfer functions, thus in some embodiments, the virtual sound processing unit is configured for generating the virtual audio sound signal forwarded to the first and second speakers by means of:

applying first head-related transfer function(s) to the audio sound received in the first speaker; and applying second head-related transfer function(s) to the audio sound received in the second speaker.

A head-related transfer function (HRTF) also sometimes known as the anatomical transfer function (ATF) is a response that characterizes how an ear receives a sound from a point in space. As sound strikes the listener, the size and shape of the head, ears, ear canal, density of the head, size and shape of nasal and oral cavities, may all transform the sound and may affect how it is perceived, boosting some frequencies and attenuating others. Generally speaking, the HRTF may boost frequencies from 2-5 kHz with a primary resonance of +17 dB at 2,700 Hz. But the response curve may be more complex than a single bump, may affect a broad frequency spectrum, and may vary significantly from person to person.

A pair of HRTFs for two ears can be used to synthesize a binaural sound that seems to come from a particular point in space. It is a transfer function, describing how a sound from a specific point will arrive at the ear (generally at the outer end of the auditory canal).

Humans have just two ears, but can locate sounds in three dimensions—in range (distance), in direction above and below, in front and to the rear, as well as to either side. This is possible because the brain, inner ear and the external ears (pinna) work together to make inferences about location.

Humans estimate the location of a source by taking cues derived from one ear (monaural cues), and by comparing cues received at both ears (difference cues or binaural cues). Among the difference cues are time differences of arrival and intensity differences. The monaural cues come from the interaction between the sound source and the human anatomy, in which the original source sound is modified before it enters the ear canal for processing by the auditory system. These modifications encode the source location, and may be captured via an impulse response which relates the source location and the ear location. This impulse response is termed the head-related impulse response (HRIR). Convolution of an arbitrary source sound with the HRIR converts the sound to that which would have been heard by the listener if it had been played at the source location, with the listener's ear at the receiver location. The HRTF is the Fourier transform of HRIR.

HRTFs for left and right ear, expressed above as HRIRs, describe the filtering of a sound source (x(t)) before it is perceived at the left and right ears as xL(t) and xR(t), respectively.

The HRTF can also be described as the modifications to a sound from a direction in free air to the sound as it arrives at the eardrum. These modifications may include the shape of the listener's outer ear, the shape of the listener's head and body, the acoustic characteristics of the space in which the sound is played, and so on. All these characteristics will influence how (or whether) a listener can accurately tell what direction a sound is coming from.

The audio sound from an external device may be stereo music. The stereo music has two audio channels sR(t) and sL(t). The two virtual sound speakers may be created at angles $+\theta_0$ and $-\theta_0$, relative to the look direction at e.g. −30 degrees and +30 degrees, by convolving the corresponding four head-related-transfer-functions (HRTF's) with sR(t) and sL(t).

Thus, in some embodiments, the virtual sound processing unit is configured for generating the virtual audio sound signal forwarded to the first and second speakers by means of:

applying a first left head-related transfer function to the left channel stereo audio sound signal of the received audio sound signal in the first earphone; and applying a first right head-related transfer function to the right channel stereo audio sound signal of the received audio sound signal in the first earphone;

and applying a second left head-related transfer function to the left channel stereo audio sound signal of the received audio sound signal in the second earphone; and applying a second right head-related transfer function to the right channel stereo audio sound signal of the received audio sound signal in the second earphone.

The virtual audio sound signal is provided by the virtual speakers. The virtual speakers may be provided 30 degrees left and right relative to a straight forward direction of the user's head.

Applying a head-related transfer function to an audio sound signal may comprise convolving.

In some embodiments, the hearing device comprises a head tracking sensor comprising an accelerometer, a magnetometer and a gyroscope. The head tracking sensor is configured for tracking the user's head movement.

In some embodiments, the hearing device is configured for compensating for the user's fast/natural head movements measured by the head tracking sensor, by providing that the two virtual speakers appear to be in a steady position in space. The user's fast/natural head movements may occur when the user walks or cycles. By providing that the two virtual speakers appear to be in a steady position in space, the virtual speakers do not appear to follow the user's fast/natural head movement, instead the virtual speakers appear steady in space in front of the user.

The head tracking sensor may estimate the look direction $\theta_{HT}$ of the user and compensate for fast changes in the head orientation angle such that the two virtual speakers stay stationary in space when the user turns his head. It is well known from the scientific literature that adding head tracking to spatial sound increase the sound externalization, i.e. the two virtual speakers will be perceived as "real" speakers in 3D space.

In some embodiments, the hearing device compensates for the user's fast/natural head movements by ensuring a latency of the virtual speakers of less than about 50 ms (milliseconds), such as less than 40 ms. It is an advantage that the latency is as low as possible and it should not exceed 50 ms. The lower the latency is, the better the system is able to let the virtual speakers stay in the same place in space during rapid head movements.

In some embodiments, the hearing device is configured for providing a rubber band effect to the virtual speakers for providing that the virtual speakers gradually shift position, when the user performs real turns other than fast/natural head movements. This may be provided for example when the user walks around a corner, such that the virtual speakers gradually will turn 90 degrees when the user's head turns 90 degrees and the head does not turn back again.

In some embodiments, the hearing device provides the rubber band effect by applying a time constant to the head tracking sensor of about 5-10 seconds.

When the user e.g. walks around a corner and rotate his/her body and head about e.g. 90 degrees the virtual speakers will "slowly" follow the look direction of the user i.e. work against the effect of the head tracker. This may be provided by having the perceived "rubber band" effect in the virtual speakers which drags them towards the look direction.

In some embodiments, the hearing device comprises a high pass filter for filtering out environment noise, such as frequencies below 500 Hz, such as below 200 Hz, such as below 100 Hz. Thus, a high pass filter may be applied on the environment sounds, e.g. traffic sounds, to filter out irrelevant environmental noise like wind.

In some embodiments, the first primary microphone and/or the first secondary microphone is/are an omnidirectional microphone or a directional microphone. For example the omnidirectional microphone may be arranged on the rear side of the earphone, such that the earphone provides a "shadow" in the front direction. Thus, both the directional microphone and the omnidirectional microphone may provide a rear facing sensitivity pattern towards the rear direction, such as a directional sensitivity pointing rearwards.

As an alternative to a directional microphone or an omnidirectional microphone, beamforming or beamformers may be used for providing the rear facing sensitivity patterns towards the rear direction.

In some embodiments, the hearing device further comprises:

a second primary microphone for capturing surrounding sounds; the second primary microphone being arranged in the first earphone;

a second secondary microphone for capturing surrounding sounds; the second secondary microphone being arranged in the second earphone;

a first beamformer configured for providing the first surrounding sound signal, where the first surrounding sound signal is based on the first primary input signal from the first primary microphone and a second primary input signal from the second primary microphone, for providing the first rear facing sensitivity pattern towards the rear direction; and a second beamformer configured for providing the second surrounding sound signal, where the second surrounding sound signal is based on the first secondary input signal from the first secondary microphone and a second secondary input signal from the second secondary microphone, for providing the second rear facing sensitivity pattern towards the rear direction.

Thus, besides the first primary microphone in the first earphone, a second primary microphone may be arranged in the first earphone for providing beamforming of the microphone signals. Likewise, besides the first secondary microphone in the second earphone, a second secondary microphone may be arranged in the second earphone for providing beamforming of the microphone signals.

In some embodiments, the hearing device further comprises:

a third primary microphone and a fourth primary microphone for capturing surrounding sounds; the third primary microphone and the fourth primary microphone being arranged in the first earphone;

a third secondary microphone and a fourth secondary microphone for capturing surrounding sounds; the third secondary microphone and the fourth secondary microphone being arranged in the second earphone;

wherein the first surrounding sound signal provided by the first beamformer is further based on a third primary input signal from the third primary microphone and a fourth primary input signal from the fourth primary microphone, for providing the first rear facing sensitivity pattern towards the rear direction; and wherein the second surrounding sound signal provided by the second beamformer is further based on a third secondary input signal from the third secondary microphone and a fourth secondary input signal from the fourth secondary microphone, for providing the second rear facing sensitivity pattern towards the rear direction.

Thus, besides the first and second microphones in each earphone, a third microphone and a fourth microphone may be provided in each earphone for improving the beamforming and therefore improving the rear facing sensitivity pattern towards the rear direction.

In some embodiments, the first primary microphone and/or the second primary microphone and/or the third primary microphone and/or the fourth primary microphone point rearwards for providing the first rear facing sensitivity pattern towards the rear direction.

In some embodiments, the first secondary microphone and/or the second secondary microphone and/or the third secondary microphone and/or the fourth secondary microphone point rearwards for providing the second rear facing sensitivity pattern towards the rear direction.

In some embodiments, the first primary microphone and/or the second primary microphone and/or the third primary microphone and/or the fourth primary microphone are arranged with a distance in a horizontal direction in the first earphone. The microphones in the first earphone may be arranged with as large a distance between each other as possible in a horizontal direction, as this may provide an improved first rear facing sensitivity pattern towards the rear direction.

In some embodiments, the first secondary microphone and/or the second secondary microphone and/or the third secondary microphone and/or the fourth secondary microphone are arranged with a distance in a horizontal direction in the second earphone. The microphones in the second earphone may be arranged with as large a distance between each other as possible in a horizontal direction, as this may provide an improved second rear facing sensitivity pattern towards the rear direction.

In some embodiments, the hearing device is configured to be connected with an electronic device, wherein the audio sound signals is transmitted from the electronic device, and wherein the audio sound signals and/or the surrounding sound signals is configured to be set/controlled by the user via a user interface. The hearing device may be connected with the electronic device by wire or wirelessly, such as via Bluetooth. The hearing device may comprise a wireless communication unit for communication with the electronic device. The wireless communication unit may be a radio communication unit and/or a transceiver. The wireless communication unit may be configured for Bluetooth (BT) communication, for Wi-Fi communication, such as 3G, 4G, 5G etc.

The electronic device may be a smartphone configured to play music or radio or enabling phone conversations etc. Thus, the audio sound signals may be music or radio or phone conversations. The audio sound may be transmitted from the electronic device via a software application on the electronic device, such as an app. The user interface may be a user interface on the electronic device, e.g. smart phone, such as a graphical user interface, e.g. an app on the electronic device. Alternatively and/or additionally, the user interface may be a user interface on the hearing device, such as a touch panel on the hearing device, e.g. push buttons etc.

The user may set or control the audio sound signals and/or the surrounding sound signals using the user interface. The user may set or control the mode of the hearing device using the user interface, such as setting the hearing device in a traffic awareness mode, where the traffic awareness mode may be according to the aspects and embodiments disclosed above and below. Other modes of the hearing device may be available as well, such as a hear-through mode, a noise cancellation mode, an audio-only mode, such as only playing music, radio etc. The hearing device may automatically set the mode itself.

According to an aspect, disclosed is a method in a hearing device for audio transmission, where the hearing device is configured to be worn by a user. The method comprises receiving an audio sound signal in a virtual sound processing unit. The method comprises processing the audio sound signal in the virtual sound processing unit for generating a virtual audio sound signal. The method comprises forwarding the virtual audio sound signal to a first speaker and a second speaker, the first and the second speaker being connected to the virtual sound processing unit, where the virtual audio sound appears to the user as audio sound coming from two virtual speakers in front of the user. The method further comprises capturing surrounding sounds by a first primary microphone to provide a first surrounding sound signal based on a first primary input signal from the first primary microphone; the first primary microphone being arranged in the first earphone for providing a first rear facing sensitivity pattern towards the rear direction. The method further comprises capturing surrounding sounds by a first secondary microphone to provide a second surrounding sound signal based on a first secondary input signal from the first secondary microphone; the first secondary microphone being arranged in the second earphone for providing a second rear facing sensitivity pattern towards the rear direction. The method comprises transmitting the first surrounding sound signal to the first speaker. The method comprises transmitting the second surrounding sound signal to the second speaker. Thereby the user receives the surrounding sound from the rear direction, while the surrounding sound from the front direction is attenuated compared to the surrounding sound from the rear direction.

The present invention relates to different aspects including the hearing device and method described above and in the following, and corresponding headsets, software applications, systems, system parts, methods, devices, networks, kits, uses and/or product means, each yielding one or more of the benefits and advantages described in connection with the first mentioned aspect, and each having one or more embodiments corresponding to the embodiments described in connection with the first mentioned aspect and/or disclosed in the appended claims.

BRIEF DESCRIPTION OF THE DRAWINGS

The above and other features and advantages will become readily apparent to those skilled in the art by the following detailed description of exemplary embodiments thereof with reference to the attached drawings, in which:

FIG. 1*a*) schematically illustrates an example of a sound environment provided by a prior art hearing device.

DETAILED DESCRIPTION

Figure 1B:
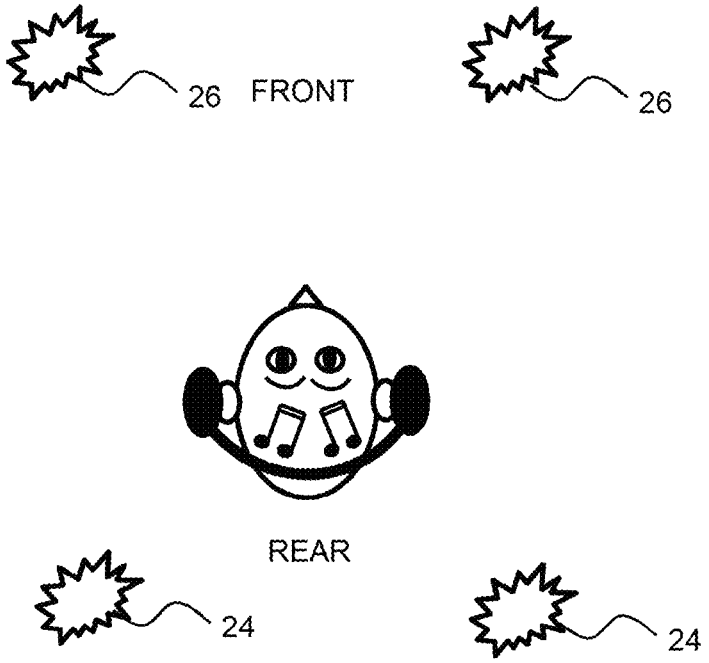
FIG. 1*b*) schematically illustrates an example of a sound environment provided by a hearing device according to the present application.
Figure 1B:
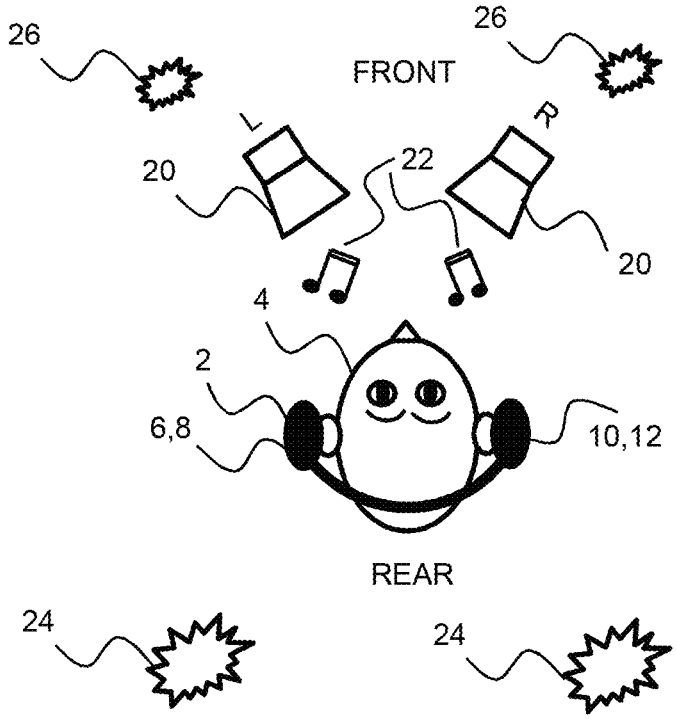

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

FIG. 1*a*) schematically illustrates an example of a sound environment provided by a prior art hearing device.

FIG. 1*b*) schematically illustrates an example of a sound environment provided by a hearing device according to the present application.

FIG. 1*a*) shows a prior art example of listening to hearing device or headphone music in a traffic environment with a normal "hear through" mode. The user hears the music and the traffic sounds blended together.

FIG. 1*b*) shows the present hearing device 2 and method, where audio, such as music, is played from the front direction through two virtual speakers 20 and traffic is mainly played from the rear direction and attenuated from the front direction.

FIG. 1*b*) schematically illustrates an exemplary hearing device 2 for audio transmission. The hearing device 2 is configured to be worn by a user 4. The hearing device 2 comprises a first earphone 6 comprising a first speaker 8. The hearing device 2 comprises a second earphone 10 comprising a second speaker 12. The hearing device 2 comprises a virtual sound processing unit (not shown) connected to the first earphone 6 and the second earphone 10. The virtual sound processing unit is configured for receiving and processing an audio sound signal for generating a virtual audio sound signal. The virtual audio sound signal is forwarded to the first speaker 8 and the second speaker 12, where the virtual audio sound appears to the user as audio sound 22 coming from two virtual speakers 20 in front of the user 4. The hearing device 2 further comprises a first primary microphone (not shows) for capturing surrounding sounds 24, 26 to provide a first surrounding sound signal based on a first primary input signal from the first primary microphone. The first primary microphone is arranged in the first earphone 6 for providing a first rear facing sensitivity pattern towards the rear direction "REAR". The hearing device 2 further comprises a first secondary microphone (not shown) for capturing surrounding sounds 24, 26 to provide a second surrounding sound signal based on a first secondary input signal from the first secondary microphone. The first secondary microphone is arranged in the second earphone 10 for providing a second rear facing sensitivity pattern towards the rear direction "REAR". The hearing device 2 is configured for transmitting the first surrounding sound signal to the first speaker 8. The hearing device 2 is configured for transmitting the second surrounding sound signal to the second speaker 12. Thereby the user 4 receives the surrounding sound 24 from the rear direction "REAR", while the surrounding sound 26 from the front direction "FRONT" is attenuated compared to the surrounding sound 24 from the rear direction "REAR". The attenuated surrounding sound 26 from the front direction "FRONT" is illustrated by the surrounding sound symbols 26 being smaller than the surrounding sound symbols 24 from the rear direction "REAR".

In the prior art example in FIG. 1*a*), the surrounding sound 26 from the front direction "FRONT" is not attenuated compared to the surrounding sound 24 from the rear direction "REAR", and this is illustrated in FIG. 1*a*) by the surrounding sound symbols 26 from the front direction "FRONT" having the same size as the surrounding sound symbols 24 from the rear direction "REAR".

Furthermore, in the prior art example FIG. 1*a*), a user wearing a hearing device will hear the audio sound, e.g. music, as stereo sound, in the head. This is illustrated in FIG. 1*a*) by the music notes inside the user's head.

Figure 2:
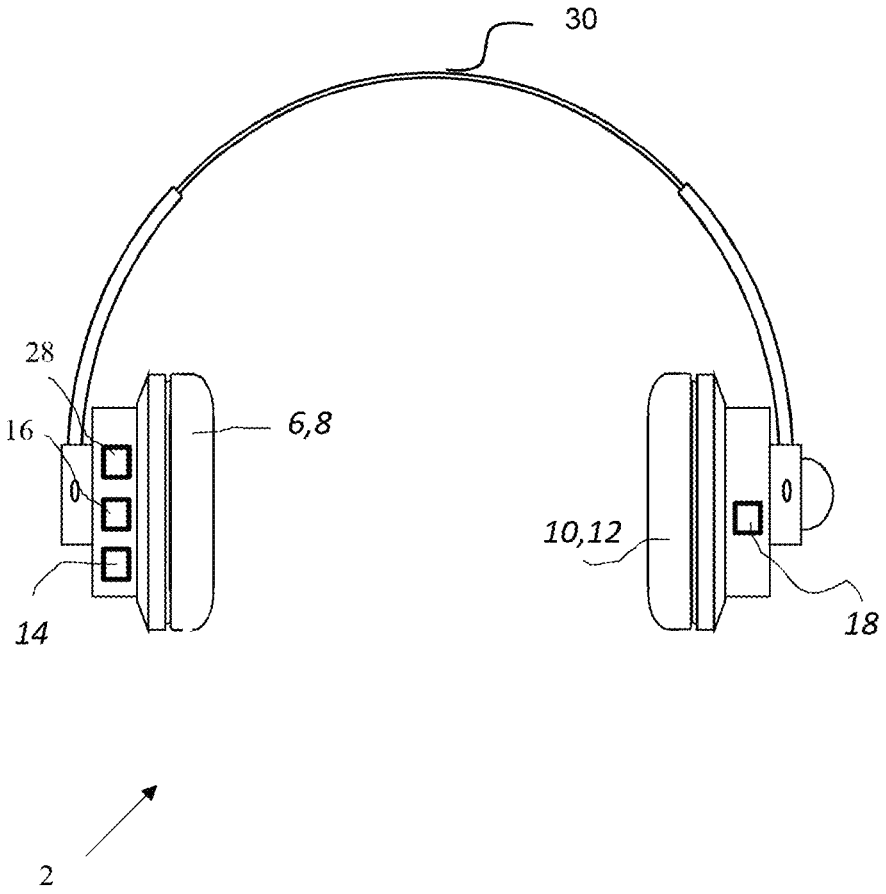
FIG. 2 schematically illustrates an exemplary hearing device for audio transmission.

FIG. 2 schematically illustrates an exemplary hearing device 2 for audio transmission. The hearing device 2 is configured to be worn by a user 4 (not shown, see FIG. 1*b*). The hearing device 2 comprises a first earphone 6 comprising a first speaker 8. The hearing device 2 comprises a second earphone 10 comprising a second speaker 12. The hearing device 2 comprises a virtual sound processing unit 14 connected to the first earphone 6 and the second earphone 10. The virtual sound processing unit 14 is configured for receiving and processing an audio sound signal for generating a virtual audio sound signal. The virtual audio sound signal is forwarded to the first speaker 8 and the second speaker 12, where the virtual audio sound appears to the user as audio sound coming from two virtual speakers 20 (not show, see FIG. 1*b*) in front of the user. The hearing device 2 further comprises a first primary microphone 16 for capturing surrounding sounds to provide a first surrounding sound signal based on a first primary input signal from the first primary microphone 16. The first primary microphone 16 is arranged in the first earphone 6 for providing a first rear facing sensitivity pattern towards the rear direction. The hearing device 2 further comprises a first secondary microphone 18 for capturing surrounding sounds to provide a second surrounding sound signal based on a first secondary input signal from the first secondary microphone 18. The first secondary microphone 18 is arranged in the second earphone 10 for providing a second rear facing sensitivity pattern towards the rear direction. The hearing device 2 is configured for transmitting the first surrounding sound signal to the first speaker 8. The hearing device 2 is configured for transmitting the second surrounding sound signal to the second speaker 12. Thereby the user receives the surrounding sound from the rear direction, while the surrounding sound from the front direction is attenuated compared to the surrounding sound from the rear direction.

The hearing device 2 may further comprise a head tracking sensor 28 comprising an accelerometer, a magnetometer and a gyroscope, for tracking the user's head movements.

The hearing device may further comprise a headband 30 connecting the first earphone 6 and the second earphone 10.

Figure 3A:
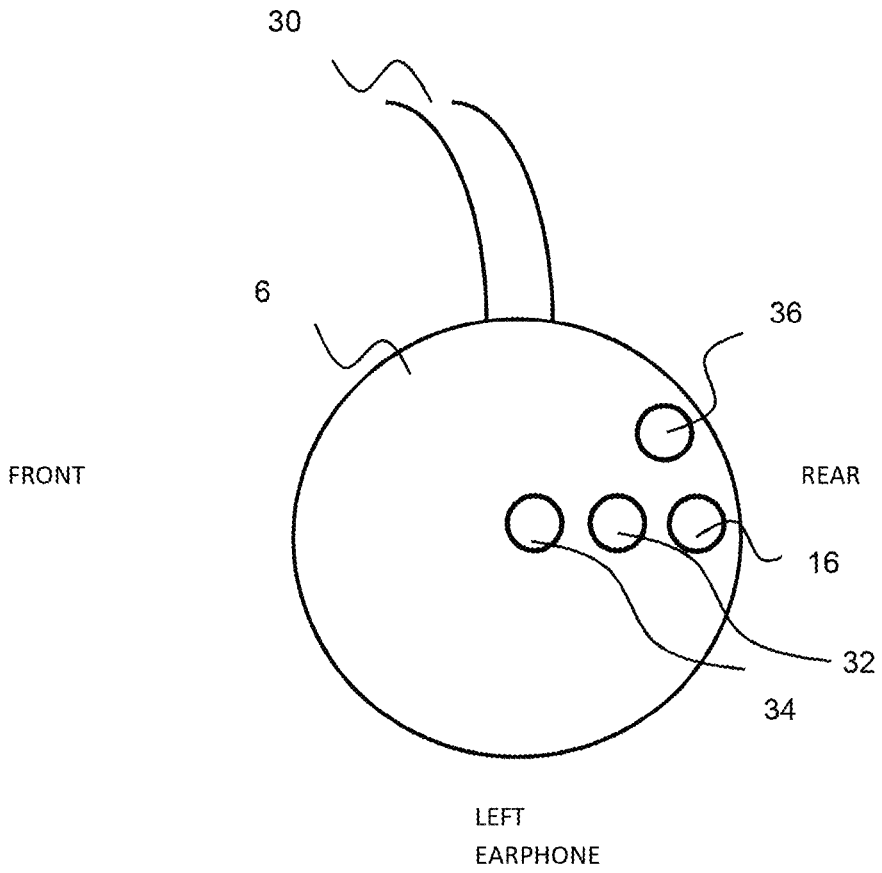
FIGS. 3*a*) and 3*b*) schematically illustrate exemplary earphones with microphones of the hearing device.

FIGS. 3*a*) and 3*b*) schematically illustrate exemplary earphones with microphones of the hearing device.

FIG. 3*a*) schematically illustrates microphones of the first earphone 6. The first earphone 6 may be the left earphone of the hearing device 2. The first earphone 6 comprises a first primary microphone 16. The first primary microphone 16 may be an omnidirectional microphone or a directional microphone providing the rear facing sensitivity pattern.

The hearing device 2 may further comprise a second primary microphone 32 for capturing surrounding sounds. The second primary microphone 32 is arranged in the first earphone 6.

The hearing device 2 may comprise a first beamformer configured for providing the first surrounding sound signal, where the first surrounding sound signal is based on the first primary input signal from the first primary microphone 16 and a second primary input signal from the second primary microphone 32, for providing the first rear facing sensitivity pattern towards the rear direction "REAR".

The hearing device may further comprise a third primary microphone 34 and a fourth primary microphone 36 for capturing surrounding sounds. The third primary microphone 34 and the fourth primary microphone 36 are arranged in the first earphone 6.

The first surrounding sound signal provided by the first beamformer is further based on a third primary input signal from the third primary microphone 34 and a fourth primary input signal from the fourth primary microphone 36, for providing the first rear facing sensitivity pattern towards the rear direction "REAR".

The first primary microphone 16 and/or the second primary microphone 32 and/or the third primary microphone 34 and/or the fourth primary microphone 36 point rearwards "REAR" for providing the first rear facing sensitivity pattern towards the rear direction.

The first primary microphone 16 and/or the second primary microphone 32 and/or the third primary microphone 34 and/or the fourth primary microphone 36 are arranged with a distance in a horizontal direction in the first earphone 6.

Figure 3B:
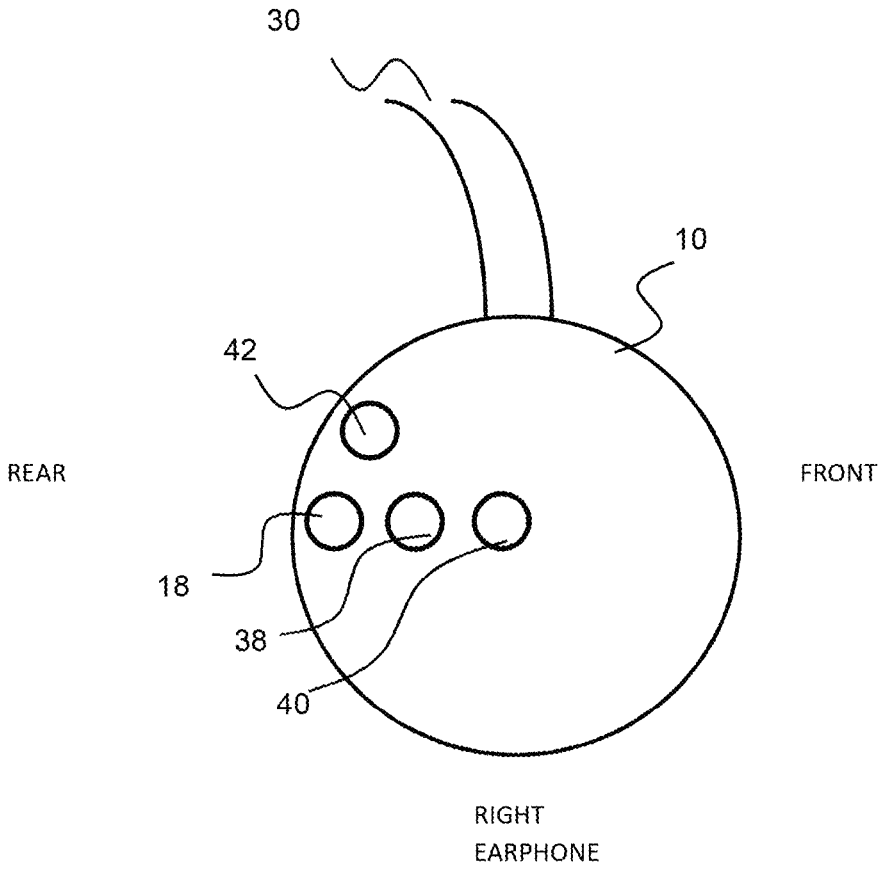

FIG. 3*b*) schematically illustrates microphones of the second earphone 10. The second earphone 10 may be the right earphone of the hearing device 2. The second earphone 10 comprises a first secondary microphone 18. The first secondary microphone 18 may be an omnidirectional microphone or a directional microphone providing the rear facing sensitivity pattern.

The hearing device 2 may further comprise a second secondary microphone 38 for capturing surrounding sounds. The second secondary microphone 38 is arranged in the second earphone 10.

The hearing device 2 may comprise a second beamformer configured for providing the second surrounding sound signal, where the second surrounding sound signal is based on the first secondary input signal from the first secondary microphone 18 and a second secondary input signal from the second secondary microphone 38, for providing the second rear facing sensitivity pattern towards the rear direction "REAR".

The hearing device may further comprise a third secondary microphone 40 and a fourth secondary microphone 42 for capturing surrounding sounds. The third secondary microphone 40 and the fourth secondary microphone 42 are arranged in the second earphone 10.

The second surrounding sound signal provided by the second beamformer is further based on a third secondary input signal from the third secondary microphone 40 and a fourth secondary input signal from the fourth secondary microphone 42, for providing the second rear facing sensitivity pattern towards the rear direction "REAR".

The first secondary microphone 18 and/or the second secondary microphone 38 and/or the third secondary microphone 40 and/or the fourth secondary microphone 42 point rearwards "REAR" for providing the second rear facing sensitivity pattern towards the rear direction.

The first secondary microphone 18 and/or the second secondary microphone 38 and/or the third secondary microphone 40 and/or the fourth secondary microphone 42 are arranged with a distance in a horizontal direction in the second earphone 10.

Figure 4A:
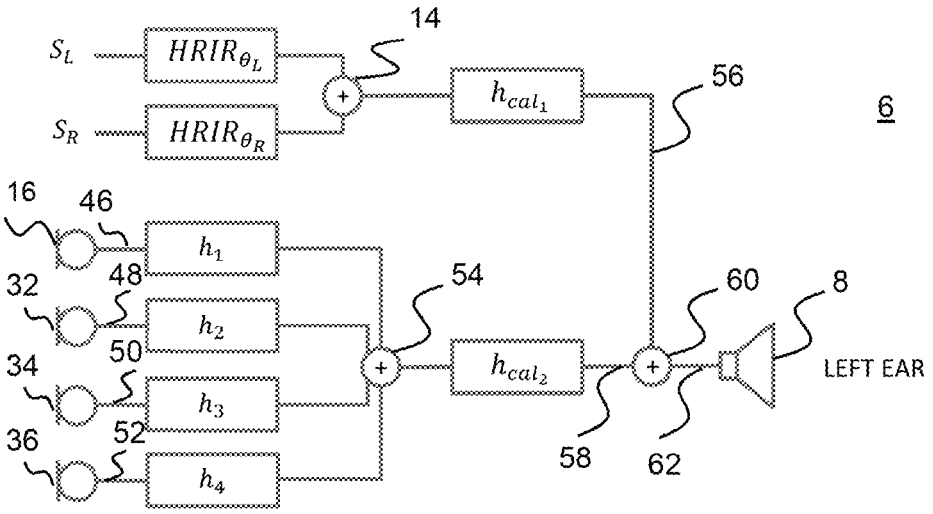
FIGS. 4*a*) and 4*b*) schematically illustrate the signal paths providing the virtual audio sound signal and the surrounding sound signal in the hearing device, see FIG. 4*a*) for the first or left earphone, and FIG. 4*b*) for the second or right earphone.
Figure 4B:
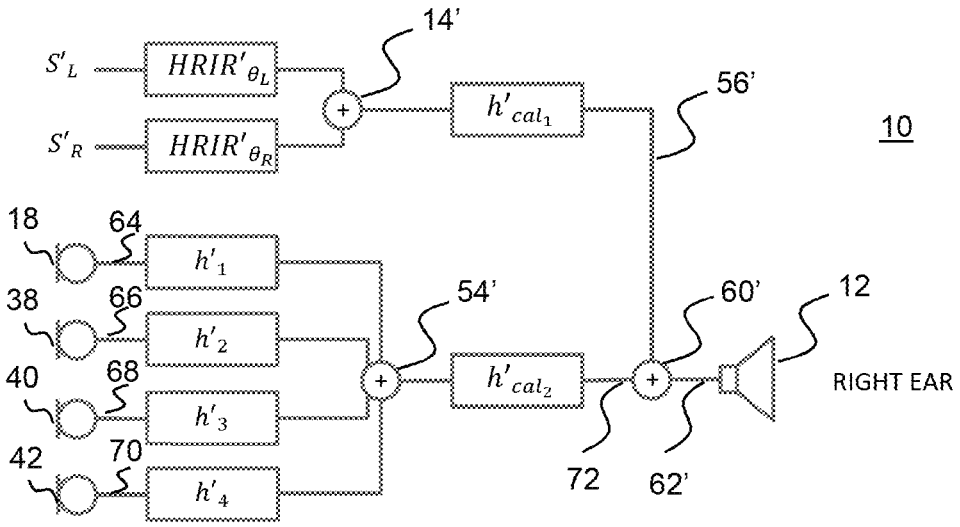

FIGS. 4*a*) and 4*b*) schematically illustrate the signal paths providing the virtual audio sound signal and the surrounding sound signal in the hearing device, see FIG. 4*a*) for the first or left earphone, and FIG. 4*b*) for the second or right earphone.

FIG. 4*a*) schematically shows the signal paths from the stereo music inputs and microphones to the earphone speaker for the first earphone, such as for the left ear of the user.

$S_L$ is the left channel stereo audio input, such as left channel stereo music input. $S_R$ is the right channel stereo audio input, such as right channel stereo music input.

HRIR in FIG. 4*a*) is the left ear Head-Related Impulse Response. Humans estimate the location of a source by taking cues derived from one ear (monaural cues), and by comparing cues received at both ears (difference cues or binaural cues). Among the difference cues are time differences of arrival and intensity differences. The monaural cues come from the interaction between the sound source and the human anatomy, in which the original source sound is modified before it enters the ear canal for processing by the auditory system. These modifications encode the source location, and may be captured via an impulse response which relates the source location and the ear location. This impulse response is termed the head-related impulse response (HRIR). Convolution of an arbitrary source sound with the HRIR converts the sound to that which would have been heard by the listener if it had been played at the source location, with the listener's ear at the receiver location. The HRTF is the Fourier transform of HRIR.

HRTFs for left and right ear, expressed above as HRIRs, describe the filtering of a sound source (x(t)) before it is perceived at the left and right ears as xL(t) and xR(t), respectively.

The stereo audio has two audio channels sR(t) and sL(t). The two virtual sound speakers may be created at angles $+\theta_0$ and $-\theta_0$, relative to the look direction at e.g. −30 degrees and +30 degrees, by convolving the corresponding four head-related-transfer-functions (HRTF's) with sR(t) and sL(t).

$\theta_L$ and $\theta_R$ are the angles to the left and right virtual speaker respectively, thus HRIR $\theta_L$ is the left ear Head-Related Impulse Response for the left virtual speaker, see FIG. 1*b*). HRIR $\theta_R$ is the left ear Head-Related Impulse Response for the right virtual speaker, see FIG. 1*b*).

The output signals from HRIR 8R and HRIR $\theta_L$ are added together at a virtual sound processing unit 14 and provided to a first calibration filter hcal1, which provides the virtual audio sound signal 56.

$h_1$, $h_2$, $h_3$, $h_4$ are the beamforming filters for each microphone input. Four microphones are shown in FIG. 4*a*), however it is understood that alternatively there may be one, two or three microphones in the first earphone 6.

Thus, h1 is a first primary beamforming filter for the first primary input signal 46 from the first primary microphone 16. h2 is a second primary beamforming filter for the second primary input signal 48 from the second primary microphone 32. h3 is a third primary beamforming filter for the third primary input signal 50 from the third primary microphone 34. h4 is a fourth primary beamforming filter for the fourth primary input signal 52 from the fourth primary microphone 36.

The output signals from the beamforming filters h1, h2, h3 and h4 are added together at an adder 54 for the first beamformer and provided to a second calibration filter hcal2, which provides the first surrounding sound signal 58.

The first h1, second h2, third h3 and fourth h4 primary beamforming filters provides the first beamformer. The first beamformer is configured for providing the first surrounding sound signal 58, where the first surrounding sound signal 58 is based on the first primary input signal 46 from the first primary microphone 16 and the second primary input signal 48 from the second primary microphone 32 and the third primary input signal 50 from the third primary microphone 34 and the fourth primary input signal 52 from the fourth primary microphone 36. The first surrounding sound signal 58 is for providing the first rear facing sensitivity pattern towards the rear direction.

The virtual audio sound signal 56 and the first surrounding sound signal 58 are added together at 60 and the combined signal 62 is provided to the first speaker 8.

FIG. 4*b*) schematically shows the signal paths from the stereo music inputs and microphones to the earphone speaker for the second earphone, such as for the right ear of the user.

$S'_L$ is the left channel stereo audio input, such as left channel stereo music input. $S'_R$ is the right channel stereo audio input, such as right channel stereo music input.

HRIR' in FIG. 4*b*) is the right ear Head-Related Impulse Response.

The stereo audio has two audio channels sR(t) and sL(t). The two virtual sound speakers may be created at angles $+\theta_0$ and $-\theta_0$, relative to the look direction at e.g. −30 degrees and +30 degrees, by convolving the corresponding four head-related-transfer-functions (HRTF's) with sR(t) and sL(t).

$\theta_L$ and $\theta_R$ are the angles to the left and right virtual speaker respectively, thus HRIR' $\theta_L$ is the right ear Head-Related Impulse Response for the left virtual speaker, see FIG. 1*b*). HRIR' 6R is the right ear Head-Related Impulse Response for the right virtual speaker, see FIG. 1*b*).

The output signals from HRIR' $\theta_R$ and HRIR' $\theta_L$ are added together at a virtual sound processing unit 14' and provided to a first calibration filter h'cal1, which provides the virtual audio sound signal 56'.

$h'_1$, $h'_2$, $h'_3$, $h'_4$ are the beamforming filters for each microphone input. Four microphones are shown in FIG. 4*b*), however it is understood that alternatively there may be one, two or three microphones in the second earphone 10.

Thus, h'1 is a first secondary beamforming filter for the first secondary input signal 64 from the first secondary microphone 18. h'2 is a second secondary beamforming filter for the second secondary input signal 66 from the second secondary microphone 38. h'3 is a third secondary beamforming filter for the third secondary input signal 68 from the third secondary microphone 40. h'4 is a fourth secondary beamforming filter for the fourth secondary input signal 70 from the fourth secondary microphone 42.

The output signals from the beamforming filters h'1, h'2, h'3 and h'4 are added together at an adder 54' for the second beamformer and provided to a second calibration filter h'cal2, which provides the second surrounding sound signal 72.

The first h'1, second h'2, third h'3 and fourth h'4 secondary beamforming filters provides the second beamformer. The second beamformer is configured for providing the second surrounding sound signal 72, where the second surrounding sound signal 72 is based on the first secondary input signal 64 from the first secondary microphone 18 and the second secondary input signal 66 from the second secondary microphone 38 and the third secondary input signal 68 from the third secondary microphone 40 and the fourth secondary input signal 70 from the fourth secondary microphone 42. The second surrounding sound signal 72 is for providing the second rear facing sensitivity pattern towards the rear direction.

The virtual audio sound signal 56' and the second surrounding sound signal 72 are added together at 60' and the combined signal 62' is provided to the second speaker 12.

Figure 5:
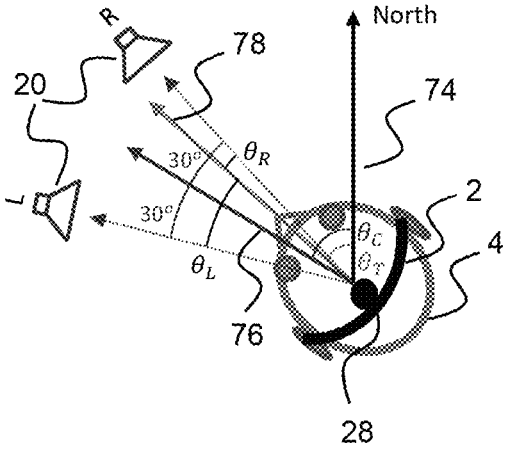
FIG. 5 schematically illustrates the virtual position of the virtual speakers by showing the angles used for selecting the head related impulse responses (HRIR's) to each virtual speaker.

FIG. 5 schematically illustrates the virtual position of the virtual speakers.

FIG. 5 shows the angles used for selecting the head related impulse responses (HRIR's) to each virtual speaker 20. $\theta_C$ is the angle between the reference direction 74 (e.g. North) and the center line 76 between the two virtual speakers 20. $\theta_T$ is the angle between the head direction 78 of the user 4 and the reference direction 74 measured with a head tracking sensor 28 of the hearing device 2. $\theta_L$ and $\theta_R$ are the angles relative to the head direction 78 ($\theta_T$) to the two virtual speakers 20, left virtual speaker L and right virtual speaker R.

The audio sound from an external device (not shown) may be stereo music. The stereo music has two audio channels sR(t) and sL(t). The two virtual sound speakers 20 may be created at angles $+\theta_0$ and $-\theta_0$, relative to the look direction or head direction 78 at e.g. −30 degrees and +30 degrees, by convolving the corresponding four head-related-transfer-functions (HRTF's) with sR(t) and sL(t).

The angles $\theta_L$ and $\theta_R$ are the angles relative to the head direction 78 ($\theta_T$) to the two virtual speakers 20, left virtual speaker L and right virtual speaker R, respectively.

$$\theta_L(n)=\theta_C(n)-\theta_T(n)+30°$$

$$\theta_R(n)=\theta_C(n)-\theta_T(n)-30°$$

In some embodiments, the hearing device 2 is configured for providing a rubber band effect to the virtual speakers 20 for providing that the virtual speakers 20 gradually shift position, when the user 4 performs real turns other than fast/natural head movements. The hearing device 2 may provide the rubber band effect by applying a time constant to the head tracking sensor 28 of about 5-10 seconds. The rubber effect may be provided by applying a time constant to the angle θT.

The following difference equation adds the "rubber band" effect to the estimation of the angles:

$$\theta_C(n)=\theta_C(n-1)-\alpha(\theta_C(n-1)-\theta_T(n-1)),\ 0<\alpha<1$$

Figure 6:
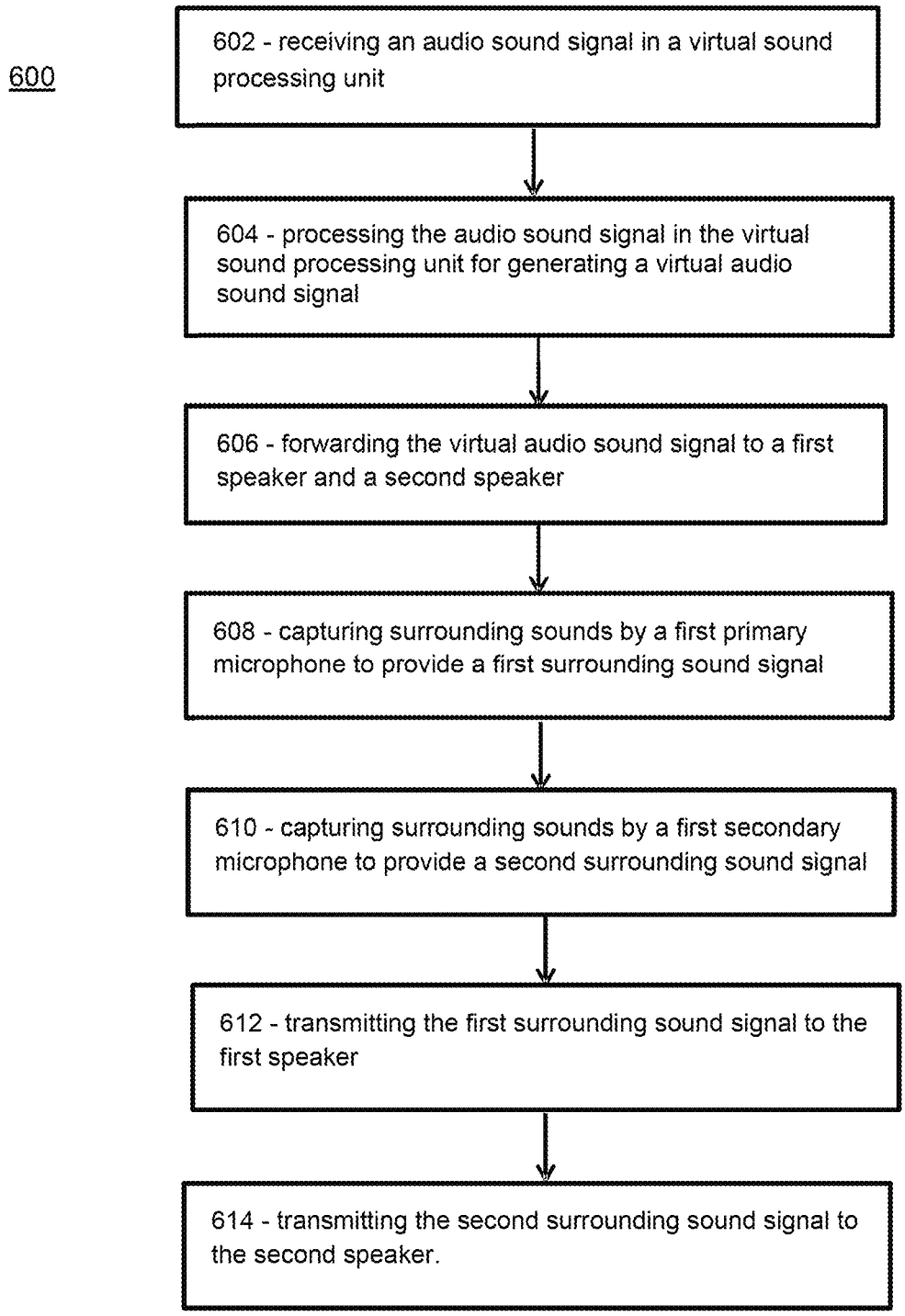
FIG. 6 schematically illustrates a method in a hearing device for audio transmission.

FIG. 6 schematically illustrates a method 600 in a hearing device for audio transmission, where the hearing device is configured to be worn by a user. The method comprises, at step 602, receiving an audio sound signal in a virtual sound processing unit. The method comprises, at step 604, processing the audio sound signal in the virtual sound processing unit for generating a virtual audio sound signal. The method comprises, at step 606, forwarding the virtual audio sound signal to a first speaker and a second speaker, the first and the second speaker being connected to the virtual sound processing unit, where the virtual audio sound appears to the user as audio sound coming from two virtual speakers in front of the user. The method further comprises, at step 608, capturing surrounding sounds by a first primary microphone to provide a first surrounding sound signal based on a first primary input signal from the first primary microphone; the first primary microphone being arranged in the first earphone for providing a first rear facing sensitivity pattern towards the rear direction. The method further comprises, at step 610, capturing surrounding sounds by a first secondary microphone to provide a second surrounding sound signal based on a first secondary input signal from the first secondary microphone; the first secondary microphone being arranged in the second earphone for providing a second rear facing sensitivity pattern towards the rear direction. The method comprises, at step 612, transmitting the first surrounding sound signal to the first speaker. The method comprises, at step 614, transmitting the second surrounding sound signal to the second speaker. Thereby the user receives the surrounding sound from the rear direction, while the surrounding sound from the front direction is attenuated compared to the surrounding sound from the rear direction.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

LIST OF REFERENCES

2 hearing device
4 user
6 first earphone
8 first speaker
10 second earphone
12 second speaker
14, 14' virtual sound processing unit
16 first primary microphone
18 first secondary microphone
20 virtual speakers
22 audio sound
24 surrounding sounds from rear direction
26 surrounding sounds from front direction
28 head tracking sensor
30 headband
32 second primary microphone
34 third primary microphone
36 fourth primary microphone
38 second secondary microphone
40 third secondary microphone
42 fourth secondary microphone
$S_L$, $S'_L$ left channel stereo audio input $S_R$, $S'_R$ right channel stereo audio input
$\theta_L$ angle to the left virtual speaker relative to head direction 78
$\theta_R$ angle to the right virtual speaker relative to head direction 78
HRIR $\theta_L$ left ear Head-Related Impulse Response for the left virtual speaker
HRIR $\theta_R$ left ear Head-Related Impulse Response for the right virtual speaker
h1 first primary beamforming filter
46 first primary input signal
h2 second primary beamforming filter
48 second primary input signal
h3 third primary beamforming filter
50 third primary input signal
h4 fourth primary beamforming filter
52 fourth primary input signal
54 adder for first beamformer
54' adder for second beamformer
h'cal1, hcal1 first calibration filter
56, 56' virtual audio sound signal
hcal2, h'cal2 second calibration filter
58 first surrounding sound signal
60, 60' adder for virtual audio sound signal 56, 56' and first/second surrounding sound signal 58/72
62, 62' combined signal
HRIR' $\theta_L$ right ear Head-Related Impulse Response for the left virtual speaker
HRIR' $\theta_R$ right ear Head-Related Impulse Response for the right virtual speaker
h'1 first secondary beamforming filter
64 first secondary input signal
h'2 second secondary beamforming filter
66 second secondary input signal 66
h'3 third secondary beamforming filter
68 third secondary input signal
h'4 fourth secondary beamforming filter
70 fourth secondary input signal
72 second surrounding sound signal
$\theta_C$ angle between the reference direction 74 and the center line 76
74 reference direction
76 center line
78 head direction of user
$\theta_T$ angle between the head direction 78 of the user 4 and the reference direction 74
600 method in a hearing device for audio transmission
602 step of receiving an audio sound signal in a virtual sound processing unit
604 step of processing the audio sound signal in the virtual sound processing unit for generating a virtual audio sound signal
606 step of forwarding the virtual audio sound signal to a first speaker and a second speaker, the first and the second speaker being connected to the virtual sound processing unit, where the virtual audio sound appears to the user as audio sound coming from two virtual speakers in front of the user
608 step of capturing surrounding sounds by a first primary microphone to provide a first surrounding sound signal based on a first primary input signal from the first primary microphone; the first primary microphone being arranged in the first earphone for providing a first rear facing sensitivity pattern towards the rear direction
610 step of capturing surrounding sounds by a first secondary microphone to provide a second surrounding sound signal based on a first secondary input signal from the first secondary microphone; the first secondary microphone being arranged in the second earphone for providing a second rear facing sensitivity pattern towards the rear direction
612 step of transmitting the first surrounding sound signal to the first speaker
614 step of transmitting the second surrounding sound signal to the second speaker

The invention claimed is:

1. A hearing device for audio transmission configured to be worn by a user, the hearing device comprises:
a first earphone comprising a first speaker;
a second earphone comprising a second speaker;
a virtual sound processing unit connected to the first earphone and the second earphone, the virtual sound processing unit is configured for receiving and processing an audio sound signal for generating a virtual audio sound signal,
wherein the virtual audio sound signal is forwarded to the first and second speakers, where the virtual audio sound appears to the user as audio sound coming from two virtual speakers in front of the user, wherein the two virtual speakers are created at angles relative to a look direction of the user;
a first primary microphone for capturing surrounding sounds to provide a first surrounding sound signal, the first primary microphone being arranged in the first earphone for providing a first rear facing sensitivity pattern towards a rear direction;
a first secondary microphone for capturing surrounding sounds to provide a second surrounding sound signal, the first secondary microphone being arranged in the second earphone for providing a second rear facing sensitivity pattern towards the rear direction;
wherein the hearing device is configured for:
transmitting the first surrounding sound signal to the first speaker; and
transmitting the second surrounding sound signal to the second speaker;
a second primary microphone for capturing surrounding sounds, the second primary microphone being arranged in the first earphone;
a second secondary microphone for capturing surrounding sounds, the second secondary microphone being arranged in the second earphone;
a first beamformer configured for providing the first surrounding sound signal, where the first surrounding sound signal is based on the first primary input signal from the first primary microphone and a second primary input signal from the second primary microphone, for providing the first rear facing sensitivity pattern towards the rear direction; and
a second beamformer configured for providing the second surrounding sound signal, where the second surrounding sound signal is based on the first secondary input signal from the first secondary microphone and a second secondary input signal from the second secondary microphone, for providing the second rear facing sensitivity pattern towards the rear direction;
wherein the virtual sound processing unit is configured for generating the virtual audio sound signal forwarded to the first and second speakers by:
applying a first left head-related transfer function to a left channel stereo audio sound signal of the received audio sound signal in the first earphone;

applying a first right head-related transfer function to a right channel stereo audio sound signal of the received audio sound signal in the first earphone;

applying a second left head-related transfer function to the left channel stereo audio sound signal of the received audio sound signal in the second earphone; and applying a second right head-related transfer function to the right channel stereo audio sound signal of the received audio sound signal in the second earphone;

wherein the surrounding sound, for the user, captured from the front direction is attenuated compared to the surrounding sound captured from the rear direction by having a higher directional sensitivity in the rear direction than the front direction such that a volume of the surrounding sound in the front direction is smaller than a volume of the surrounding sound in the rear direction.

2. The hearing device according to claim 1, wherein the hearing device comprises a head tracking sensor comprising an accelerometer, a magnetometer and a gyroscope.

3. The hearing device according to claim 2, wherein the hearing device is configured for compensating for the user's fast/natural head movements measured as the look direction by the head tracking sensor, by providing that the two virtual speakers appear to be in a steady position in space.

4. The hearing device according to claim 3, wherein the hearing device compensates for the user's fast/natural head movements by ensuring a latency of the virtual speakers of less about 50 ms.

5. The hearing device according to claim 2, wherein the hearing device is configured for providing a rubber band effect to the virtual speakers for providing that the angles of the virtual speakers gradually shift, when the user performs real turns other than fast/natural head movements.

6. The hearing device according to claim 5, wherein the hearing device provides the rubber band effect by applying a time constant to the head tracking sensor of about 5-10 seconds.

7. The hearing device according to claim 6, wherein the hearing device comprises a high pass filter for filtering out environment noise, including frequencies below 500 Hz.

8. The hearing device according to claim 7, wherein the first primary microphone and/or the first secondary microphone is/are an omnidirectional microphone or a directional microphone.

9. The hearing device according to claim 1, wherein the hearing device further comprises:

a third primary microphone and a fourth primary microphone for capturing surrounding sounds; the third primary microphone and the fourth primary microphone being arranged in the first earphone;

a third secondary microphone and a fourth secondary microphone for capturing surrounding sounds; the third secondary microphone and the fourth secondary microphone being arranged in the second earphone;

wherein the first surrounding sound signal provided by the first beamformer is further based on a third primary input signal from the third primary microphone and a fourth primary input signal from the fourth primary microphone, for providing the first rear facing sensitivity pattern towards the rear direction; and wherein the second surrounding sound signal provided by the second beamformer is further based on a third secondary input signal from the third secondary microphone and a fourth secondary input signal from the fourth secondary microphone, for providing the second rear facing sensitivity pattern towards the rear direction.

10. The hearing device according to claim 9, wherein the first primary microphone and/or the second primary microphone and/or the third primary microphone and/or the fourth primary microphone point rearwards for providing the first rear facing sensitivity pattern towards the rear direction.

11. The hearing device according to claim 9, wherein the first primary microphone and/or the second primary microphone and/or the third primary microphone and/or the fourth primary microphone are arranged with a distance in a horizontal direction in the first earphone.

12. The hearing device according to claim 1, wherein the hearing device is configured to be connected with an electronic device, wherein the audio sound signals is transmitted from the electronic device, and wherein the audio sound signals and/or the surrounding sound signals is configured to be set/controlled by the user via a user interface.

13. The hearing device according to claim 1, wherein the hearing device is configured to change modes selected from at least one of traffic awareness mode, hear-through mode, a noise cancellation mode, or an audio-only mode.

14. The hearing device according to claim 1, wherein the surrounding sound captured from the rear direction has the higher directional sensitivity of about 3-5 dB.

15. A method in a hearing device for audio transmission, where the hearing device is configured to be worn by a user, the method comprises:

receiving an audio sound signal in a virtual sound processing unit;

processing the audio sound signal in the virtual sound processing unit for generating a virtual audio sound signal;

forwarding the virtual audio sound signal to a first speaker and a second speaker, the first and the second speaker being connected to the virtual sound processing unit, where the virtual audio sound appears to the user as audio sound coming from two virtual speakers in front of the user, wherein the two virtual speakers are created at angles relative to a look direction of the user;

wherein the method further comprises:

capturing surrounding sounds by a first primary microphone to provide a first surrounding sound signal based on a first primary input signal from the first primary microphone; the first primary microphone being arranged in a first earphone for providing a first rear facing sensitivity pattern towards a rear direction;

capturing surrounding sounds by a first secondary microphone to provide a second surrounding sound signal based on a first secondary input signal from the first secondary microphone; the first secondary microphone being arranged in a second earphone for providing a second rear facing sensitivity pattern towards the rear direction;

wherein the method comprises:

transmitting the first surrounding sound signal to the first speaker;

transmitting the second surrounding sound signal to the second speaker; and attenuating, for the user, the surrounding sound captured from the front direction compared to the surrounding sound captured from the rear direction by having a higher directional sensitivity in the rear direction than the front direction such that a volume of the surrounding sound in the front direction is smaller than a volume of the surrounding sound in the rear direction.

* * * * *